US005085892A

United States Patent [19]

Corona et al.

[11] Patent Number: 5,085,892

[45] Date of Patent: Feb. 4, 1992

[54] LAUNDRY DRYER SHEET

[75] Inventors: Raynold J. Corona; James E. Borland; Kim R. Smith, all of Baton Rouge, La.

[73] Assignee: Ethyl Corporation, Richmond, Va.

[21] Appl. No.: 591,215

[22] Filed: Oct. 1, 1990

Related U.S. Application Data

[63] Continuation-in-part of Ser. No. 476,540, Feb. 7, 1990, abandoned.

[51] Int. Cl.[5] ..... B05D 3/12

[52] U.S. Cl. ..... 427/365; 427/394; 252/8.8

[58] Field of Search ..... 427/242, 394, 365; 252/8.8

[56] References Cited

U.S. PATENT DOCUMENTS

| | | | |
|---|---|---|---|
| 3,686,025 | 8/1972 | Morton et al. | 427/140 R |
| 3,962,100 | 6/1976 | Murphy et al. | 252/8.8 |
| 4,153,561 | 5/1979 | Hümüller et al. | 252/8.8 X |
| 4,310,426 | 1/1982 | Smeltz | 252/8.8 |
| 4,488,974 | 12/1984 | Keil et al. | 252/8.8 |
| 4,885,107 | 12/1989 | Wetzel | 252/106 |

*Primary Examiner*—Michael Lusigman
*Assistant Examiner*—Alain Bashore
*Attorney, Agent, or Firm*—Patricia J. Hogan

[57] ABSTRACT

Laundry dryer sheets having a good loading of surfactant are prepared by (1) coating an absorbent flexible substrate with a molten tert-amine oxide wherein the molecules correspond to the formula $RR'R''NO.nH_2O$ in which R is a primary alkyl group containing 9–24 carbons; R′ is methyl, ethyl, or 2-hydroxyethyl; R″ is independently selected from methyl, ethyl, 2-hydroxyethyl, and primary alkyl groups containing 8–24 carbons; and n is 0, 1, or 2, at least some of the molecules being dihydrate molecules, and (2) solidifying the amine oxide.

10 Claims, No Drawings

LAUNDRY DRYER SHEET

CROSS-REFERENCE TO RELATED APPLICATION

This application is a continuation-in-part of copending application Ser. No. 476,540, filed Feb. 7, 1990 now abandoned.

FIELD OF INVENTION

The invention relates to laundry dryer sheets and more particularly to such sheets incorporating an amine oxide as a surfactant.

BACKGROUND

As disclosed, e.g., in U.S. Pat. No. 3,686,025 (Morton) it is known that absorbent flexible substrates can be impregnated with certain surfactants, including some amine oxides, to form laundry dryer sheets that can be used to soften laundry while it is being dried in an automatic dryer.

Because of their ability to act as antistatic agents as well as softening agents, mixed tert-amine oxides, i.e., tert-amine oxides containing at least one long-chain group and at least one short-chain group, are desirable surfactants to use in the preparation of dryer sheets. However, as disclosed in European Patent Application 0307184 (Bauer et al.), such oxides have typically had to be prepared as dilute aqueous solutions in order to avoid gelation problems; and it has been found that the use of such dilute solutions necessitates a drying step in the preparation of laundry dryer sheets and reduces the amount of surfactant that can be incorporated into the sheets.

Copending application Ser. No. 415,910 (Smith et al.), filed Oct. 2, 1989 now abandoned, discloses novel solid non-hygroscopic mixed tert-amine oxide dihydrates and teaches that they may be used as fabric softeners in dry solid laundry detergent compositions. Copending application Ser. No. 591,425) (Borland et al.), filed Oct. 1, 1990, expands upon the teachings of Smith et al. to include mixtures of the dihydrates with monohydrate and anhydrous amine oxide molecules.

SUMMARY OF INVENTION

It has now been found that laundry dryer sheets having a good loading of surfactant can be prepared without the need for a drying step by (1) coating an absorbent flexible substrate with a molten tert-amine oxide wherein the molecules correspond to the formula $RR'R''NO.nH_2O$ in which R is a primary alkyl group containing 8-24 carbons; R' is methyl, ethyl, or 2-hydroxyethyl; R'' is independently selected from methyl, ethyl, 2-hydroxyethyl, and primary alkyl groups containing 8-24 carbons; and n is 0, 1, or 2, at least some of the molecules being dihydrate molecules, and (2) solidifying the amine oxide.

DETAILED DESCRIPTION

The absorbent flexible substrate used in preparing the dryer sheets may be any of the substrates typically employed in making such sheets, since the only requirement for the substrate is that it be an absorbent flexible material in sheet form. For example, it may be a sponge, paper, or woven or non-woven cloth, especially a non-woven cloth made from fibers or filaments of a material such as wool, silk, jute, hemp, cotton, linen, sisal, ramie, rayon, cellulose esters, vinyl polymers, polyamide, polyesters, and the like. A particularly desirable substrate is a sheet of non-woven polyethylene terephthalate cloth.

The tert-amine oxide utilized in the practice of the invention may be one in which any primary alkyl group is a straight- or branched-chain group, but the preferred oxides are those in which at least most of the primary alkyl groups have a straight chain. Exemplary of these oxides are the dihydrates of N,N-dimethyloctylamine oxide, N,N-didecylmethylamine oxide, N-decyl-N-dodecylethylamine oxide, N,N-dimethyldodecylamine oxide, N,N-dimethyltetradecylamine oxide, N-tetradecyl-N-ethylmethylamine oxide, N-tetradecyl-N-ethyl-2-hydroxyethylamine oxide N,N-ditetradecyl-2-hydroxyethylamine oxide, N,N-dimethylhexadecylamine oxide, N,N-di-2-hydroxyethylhexadecylamine oxide N,N-dimethyloctadecylamine oxide, N,N-eicosylethylamine oxide N-docosyl-N-2-hydroxyethylmethylamine oxide, N,N-dimethyltetracosylamine oxide, etc., and mixtures thereof with one another and/or with the corresponding monohydrates and anhydrous amine oxides. Particularly useful compounds are N,N-dimethyltetradecylamine oxide dihydrate and N,N-dimethyloctadecylamine oxide dihydrate.

The tert-amine oxides that are used may be prepared by the process of Borland et al., the teachings of which are incorporated herein by reference. More specifically, thay may be prepared by oxidizing the corresponding tert-amines with aqueous hydrogen peroxide in an organic solvent in which the amines and amine oxides are soluble at the reaction temperatures but in which the amine oxides are insoluble at a lower temperature and (2) adjusting the water content of the products, if necessary, to achieve a water/amine oxide mol ratio not higher than about 2.1/1 before the amine oxide is recovered. In this reaction:

(A) the aqueous hydrogen peroxide is employed in at least a stoichiometric amount, and its amount and concentration are preferably such as to make it unnecessary to adjust the water content of the product at the end of the reaction, (B) the organic solvent is used in an amount sufficient to maintain a stirrable reaction mixture and is preferably ethyl acetate, although other substantially inert esters, hydrocarbons, halohydrocarbons, and highly polar aprotic solvents are also usable, (C) the reaction is conducted by adding the aqueous hydrogen peroxide to the amine, preferably at a controlled rate and preferably in the presence of carbon dioxide or a chelating agent (such as diethylenetriaminepentaacetic acid) to improve the reaction rate, at a temperature of 20°-100° C., preferably about 25°-80° C., and (D) the reaction mixture is cooled at the end of the reaction to precipitate the amine oxide.

When the product of this reaction has a water/amine oxide mol ratio in the range of about 1.9-2.1/1 at the time that the amine oxide is recovered, the amine oxide is recovered as a dihydrate. When the water/amine oxide mol ratio is lower than about 1.9/1, the recovered amine oxide contains some dihydrate molecules as well as other molecules indicated by the above formula.

The process of the invention is conveniently conducted by soaking the absorbent flexible substrate in a molten tert-amine oxide dihydrate or a molten mixture of tert-amine oxide molecules comprising some dihydrate molecules, thus coating and inherently impregnating it with the surfactant; passing the soaked sheet between two rollers, as in a roller press, to remove any excess amine oxide; and allowing the remaining amine oxide to solidify.

The invention is advantageous in that it eliminates the necessity for a bothersome drying step in incorporating a mixed tert-amine oxide into a laundry dryer sheet, and it also increases the loading of tert-amine oxide that can be incorporated.

The following examples are given to illustrate the invention and are not intended as a limitation thereof.

EXAMPLE

A sheet of non-woven polyethylene terephthalate cloth that was approximately 25 cm×33 cm and weighed 10.2 g was soaked in N,N-dimethyltetradecylamine oxide dihydrate, which had been heated to 50° C. to melt it. The soaked sheet was passed between the two rollers of a roller press to remove any excess surfactant, and the N,N-dimethyltetradecylamine oxide dihydrate remaining in or on the sheet was allowed to solidify. The treated sheet was weighed and determined to have a weight of 24.1 g—an increase of 236%.

When three cotton towels, which had been previously washed to remove any chemicals remaining from the process used in their production, were dipped in tap water, wrung to remove excess water, and tumbled dry in the presence of the dryer sheet, they were determined to be noticeably softer than a comparable three towels which were tumbled dry in the absence of a fabric softner.

COMPARATIVE EXAMPLE

The preceding Example was essentially repeated except that the weight of the non-woven polyethylene terephthalate cloth before treatment was 11.14 g, the material used to soak it was a 30% aqueous solution of N,N-dimethyltetradecylamine oxide, and the soaked sheet had to be allowed to dry after being pressed to remove any excess surfactant. The treated sheet was weighed and determined to have a weight of 15.07 g—an increase of only 132%.

What is claimed is:

1. A process for preparing a laundry dryer sheet which comprises (A) coating an absorbent flexible substrate with a molten tert-amine oxide wherein the molecules correspond to the formula $RR'R''NO.nH_2O$ in which R is a primary alkyl group containing 8–24 carbons; R′ is methyl, ethyl, or 2-hydroxyethyl; R″ is independently selected from methyl, ethyl, 2-hydroxyethyl, and primary alkyl groups containing 8–24 carbons; and n is 0, 1, or 2, at least some of the molecules being dihydrate molecules, and (B) solidifying the amine oxide.

2. The process of claim 1 wherein the absorbent flexible substrate is a sheet of non-woven polyethylene terephthalate cloth.

3. The process of claim 1 wherein the amine oxide is a mixture of the dihydrate, the monohydrate, and the anhydrous amine oxide.

4. The process of claim 1 wherein the amine oxide is the dihydrate.

5. The process of claim 4 wherein the amine oxide dihydrate is N,N-dimethyltetradecylamine oxide dihydrate.

6. The process of claim 4 wherein the amine oxide dihydrate is N,N-dimethyloctadecylamine oxide dihydrate.

7. The process of claim 1 wherein the laundry dryer sheet is prepared by (A) soaking the absorbent flexible substrate with the molten tert-amine oxide, (B) passing the soaked sheet through a roller press to remove any excess tert-amine oxide, and (C) allowing the remaining tert-amine oxide to solidify.

8. The process of claim 7 wherein the absorbent flexible substrate is a sheet of non-woven polyethylene terephthalate cloth.

9. The process of claim 8 wherein the tert-amine oxide is N,N-dimethyltetradecylamine oxide dihydrate.

10. The process of claim 8 wherein the tert-amine oxide is N,N-dimethyloctadecylamine oxide dihydrate.

* * * * *

UNITED STATES PATENT AND TRADEMARK OFFICE

CERTIFICATE OF CORRECTION

PATENT NO. : 5,085,892

DATED : February 4, 1992

INVENTOR(S) : Raynold J. Corona et al.

It is certified that error appears in the above-identified patent and that said Letters Patent is hereby corrected as shown below:

title page: lines 6 and 7 of the Abstract, reads "9-24 carbons" and should read -- 8-24 carbons --.

Signed and Sealed this

Eighteenth Day of May, 1993

*Attest:*

Michael K. Kirk

MICHAEL K. KIRK

*Attesting Officer*

*Acting Commissioner of Patents and Trademarks*